US006089368A

United States Patent [19]

Lindgren et al.

[11] Patent Number: 6,089,368

[45] Date of Patent: Jul. 18, 2000

[54] MULTIPACK WITH PACKAGING CONTAINER BLANKS

[75] Inventors: Christer Lindgren, Rydsgård; Magnus Sjögren; Tomas Nilén, both of Lund, all of Sweden

[73] Assignee: Tetra Laval Holdings & Finance S.A., Pully, Switzerland

[21] Appl. No.: 08/955,610

[22] Filed: Oct. 22, 1997

[30] Foreign Application Priority Data

Nov. 1, 1996 [SE] Sweden ..... 9604003

[51] Int. Cl.[7] ..... B65D 71/00

[52] U.S. Cl. ..... 206/223; 206/499

[58] Field of Search ..... 206/499, 525, 206/525.1, 425, 436, 434, 216, 223

[56] References Cited

U.S. PATENT DOCUMENTS

| | | | |
|---|---|---|---|
| 3,420,366 | 1/1969 | Doyle . | |
| 4,731,978 | 3/1988 | Martensson . | |
| 4,744,464 | 5/1988 | Noe | 206/499 X |
| 4,805,891 | 2/1989 | Luperti et al. . | |
| 4,828,636 | 5/1989 | Rausing . | |
| 4,896,901 | 1/1990 | Ekelund . | |
| 4,898,301 | 2/1990 | Schick . | |
| 4,998,637 | 3/1991 | Marovskis . | |
| 5,450,961 | 9/1995 | Gottfried et al. | 206/499 X |
| 5,470,016 | 11/1995 | Ljungström et al. . | |
| 5,489,464 | 2/1996 | Björk . | |
| 5,537,803 | 7/1996 | Olsén . | |

FOREIGN PATENT DOCUMENTS

| | | |
|---|---|---|
| 0326730 A1 | 8/1989 | European Pat. Off. . |
| 0327819 A1 | 8/1989 | European Pat. Off. . |
| 3900082 A1 | 7/1989 | Germany . |

*Primary Examiner*—Jacob K. Ackun
*Attorney, Agent, or Firm*—Burns, Doane, Swecker & Mathis, L.L.P.

[57] ABSTRACT

The disclosure relates to a multipack with flat-laid blanks intended to be filled and formed in a filling machine. The multipack includes packaging container blanks which are stacked in a compact manner and which are provided with projecting opening arrangements (2). The packaging container blanks (1) are disposed pairwise and alternatingly in such a manner that the opening arrangements (2) assume four different positions, ensuring that the multipack obtains compact form at the same time as the packaging container blanks are given optimum protection. The multipack also includes a protective envelope or casing (7) of, for example, corrugated cardboard.

1 Claim, 2 Drawing Sheets

MULTIPACK WITH PACKAGING CONTAINER BLANKS

TECHNICAL FIELD

The present invention relates to a multipack with blanks for packaging containers, the blanks being flat-laid, rectangular and provided with an opening arrangement projecting from one side of the blank.

BACKGROUND ART

In the production of packaging containers for beverages, use is occasionally made of prefabricated, possibly sterilized, packaging container blanks produced from a packaging laminate of paper, thermoplastic and possibly aluminium foil, and also provided with some form of opening arrangement. One such packaging container, as well as a machine for producing the packaging containers (i.e. filling and final forming of the blanks) is described in Swedish Patent No. 9400506-3, to which reference is now made for further information. The prefabricated blanks are thus delivered in the flat-laid state, i.e. the packaging container blanks are flat-laid so that opposing walls abut against one another and the blanks will be substantially two-dimensional. In those cases when the blanks are provided with a projecting portion, for example an opening arrangement or an arrangement for both filling and pouring of the liquid contents of the packaging container, closely packed stacking of the flat-laid blanks is prevented, since the projecting portion imparts to the blanks a third dimension and creates spaces between the blanks when they are stacked on one another. Such stacking thus fails to give symmetric, straight stacks, but instead stacks which tilt or slope to a greater or lesser extent. Stacking which causes abutment pressure on the projecting portions may also readily result in damage to them or to the blanks themselves, so that filling of the packaging container blanks or emptying of their contents is either prevented or impeded. In symmetric placing of the projecting portions, nor can the blanks be turned to face one another, since, also in these positions, the projecting portions will be located in register with one another. Stacking of this type of blanks in a multipack casing thus creates, on the one hand, an asymmetric stacking pattern (which necessitates the employment of oblique or asymmetric multipacks) and/or large spaces which are unused and "air filled". In addition, there is the risk that concentrated point loading on the edges of the blanks or on the projecting portions will cause damage to them so that the opening and/or filling function is jeopardised.

There is thus a general need in the art to provide a multipack or group package for this type of flat-laid packaging container blank provided with projecting opening arrangements, the multipack making it possible to stack the blanks in a compressed and space-saving manner adjacent one another at the same time as the risk of damage to the opening arrangements of the blanks proper is reduced to a minimum.

OBJECTS OF THE INVENTION

One object of the present invention is to realise a multipack of blanks for packaging containers of the type disclosed by way of introduction, the multipack obviating the drawbacks inherent in prior art multipacks or group packages and making for compact stacking which, at the same time, protects the blanks and the opening arrangements by distributing the loading as uniformly as possible.

A further object of the present invention is to realise a multipack for flat-laid packaging container blanks, the multipack containing flat-laid packaging container blanks which are oriented and placed in an envelope or casing such that the loading on both the opening arrangements and the flat-laid blanks is distributed such that point loadings which may damage the blanks or the opening arrangements applied thereon are avoided.

Still a further object of the present invention is to realise a multipack of blanks which are arranged such that they may readily be combined to form a compact group and also be removed from the envelope or casing of the multipack in a simple manner.

SOLUTION

The above and other objects have been attained according to the present invention in that a multipack of the type described by way of introduction has been given the characterizing features that the opening arrangement is placed outside the lines of symmetry of the blank and at an upper end of the blank, that the blanks are placed pairwise adjacent one another with longitudinal and transverse edges respectively, in common planes, that the blanks included in each pair are placed with their opening arrangements towards one another and with the upper ends in the same direction, and that every other pair is turned through 180° so that the pairs have their upper ends turned alternatingly in opposite directions, the blanks being placed in substantially vertical position in the casing of the multipack and in abutment against the bottom of the multipack.

In a multipack of this design, flat-laid blanks provided with projecting opening arrangements can be placed in a compact and protective manner in an outer envelope or casing of, for example, corrugated cardboard or shrink film.

BRIEF DESCRIPTION OF THE ACCOMPANYING DRAWINGS

One preferred embodiment of the multipack according to the present invention will now be described in greater detail hereinbelow, with particular reference to the accompanying Drawings which show only those details indispensale to an understanding of the invention. In the accompanying Drawings.

DESCRIPTION OF PREFERRED EMBODIMENT

Figure 1:
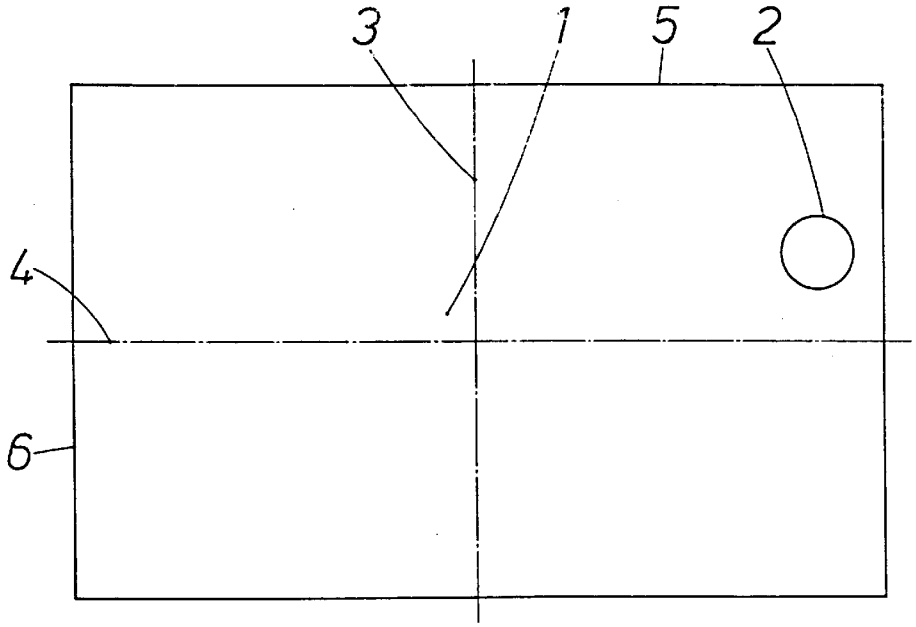
FIG. 1 is a plan view of a packaging container blank for the multipack according to the present invention.

A packaging container blank of the type which is described in Swedish Patent No. 9400506-3, to which reference is now made, is shown in FIG. 1. It will be apparent from the Drawing figure how the packaging container blank is square or rectangular and is provided on its one side with a projecting portion, for example a round neck-shaped opening arrangement 2. The opening arrangement 2 is placed outside the lines of symmetry 3, 4 of the blank. The blank is preferably produced from laminated material, for example plastic coated paper, which is double-folded and sealed (not shown) along the longitudinal and transverse edges 5, 6. The blank 1 may also be provided with a number (not shown) of fold or crease lines which are intended to facilitate the final forming of the packaging container blank 1 into, for example, parallelepipedic packaging containers filled with the desired contents, for example juice.

Figure 2:
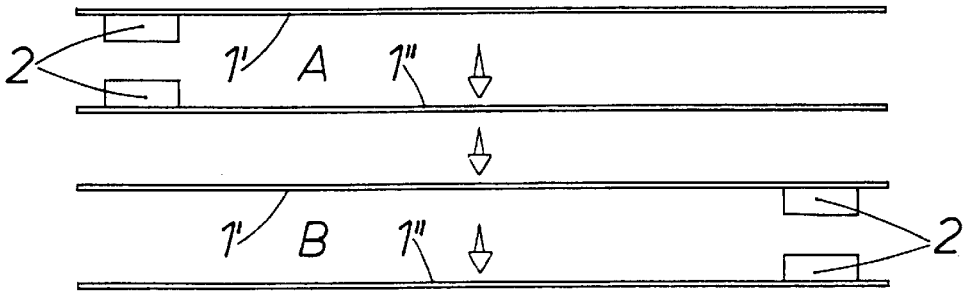
FIG. 2 shows a number of packaging container blanks according to FIG. 1 from the side.

In order to make for compact stacking and at the same time to protect the edges of the packaging container blanks and the projecting opening arrangements 2 during transport and handling of the flat-laid packaging container blanks (which have possibly been sterilized beforehand), the blanks are brought together pairwise in the manner illustrated in FIG. 2, namely a first pair A and a second pair B. The blanks 1' and 1" included in the first pair A are placed pairwise adjacent one another with longitudinal and transverse edges 5, 6, respectively in common planes with a 90° mutual angle. The blanks 1', 1" are further oriented such that the sides provided with the opening arrangements are turned to face towards one another, at the same time as the upper ends of the packaging containers provided with the opening arrangements 2 are turned to face in the same direction.

The packaging containers 1' and 1" included in the second pair B are mutually oriented and placed in a corresponding manner, but the pairs A and B are turned through 180° in relation to one another such that the upper end of the pair A is turned to face in one direction (to the left in FIG. 2), and the upper end of the pair B is turned to face in the opposite direction (to the right in FIG. 2).

Figure 3:
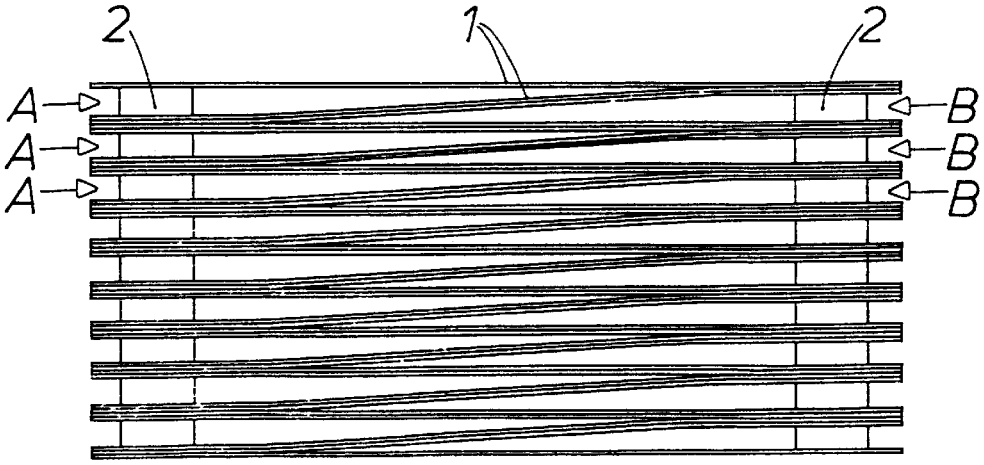
FIG. 3 is a side elevation of a number of packaging container blanks according to FIG. 1 brought together to form a compact group.
Figure 4:
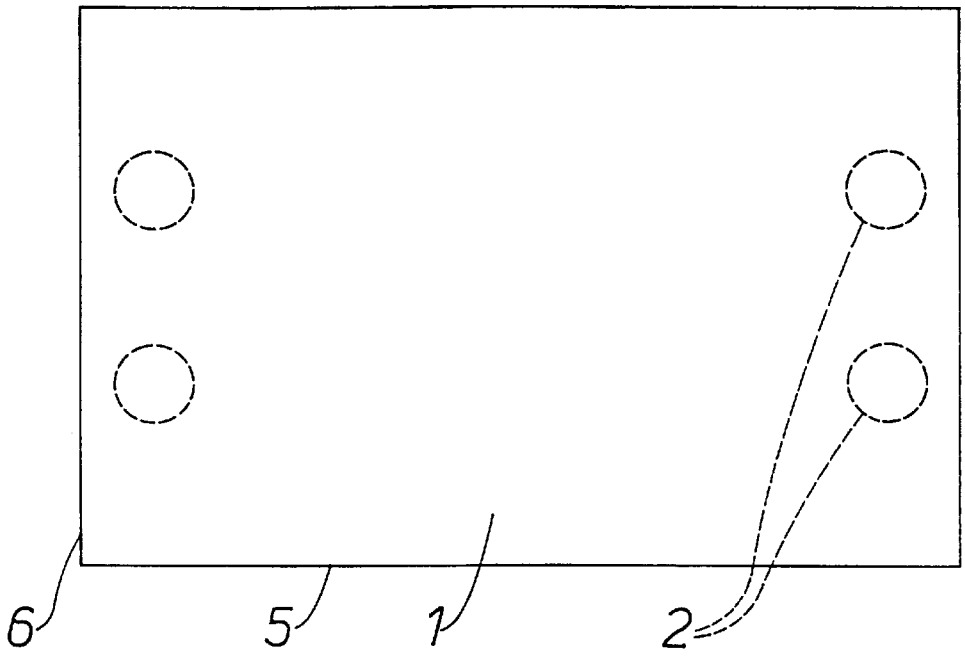
FIG. 4 is a plan view of the packaging containers stacked according to FIG. 3.
Figure 5:
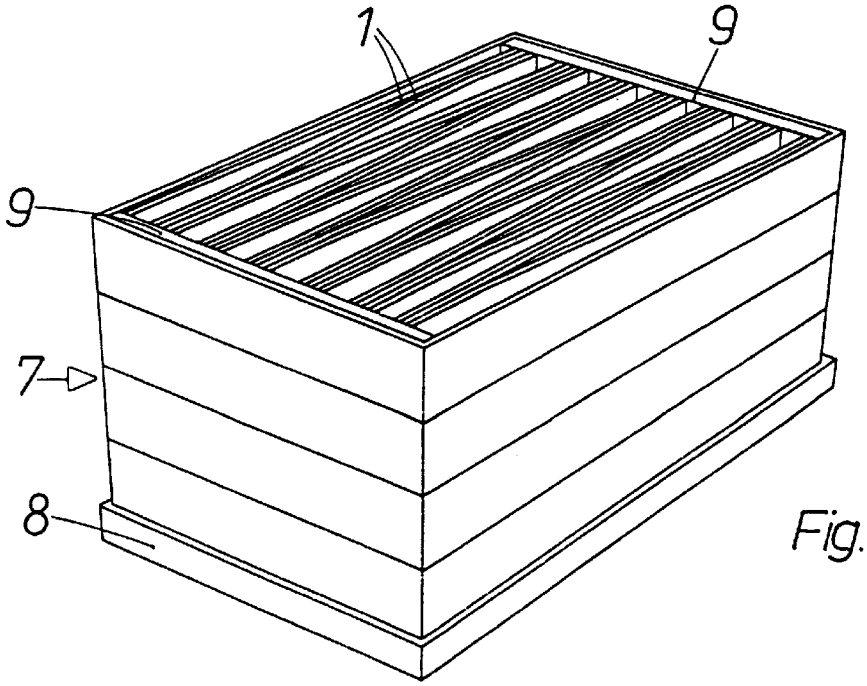
FIG. 5 shows a multipack according to the present invention provided with a corrugated cardboard envelope or casing.

After the grouping of a number of pairs A and B into a compact stack, the packaging pattern which is illustrated in FIG. 3 will be created. It is apparent from FIG. 3 how the pairs are stacked with every other pair A and every other pair B, i.e. every other pair is turned through 180° in relation to neighbouring pairs. Hereby, the upper ends of the pairs A and the pairs B provided with the opening arrangements 2 will be turned to face alternatingly in opposite directions such that the opening arrangements 2, as is apparent in FIG. 4, will be marshalled in four groups symmetrically distributed over the surface area of the stack. As a result of this placing and orientation of the blanks 1, the difference in height between the opening arrangements 2 and the remaining parts of the packaging container blanks 1 will, to the greatest possible extent, be reduced with the result that the stack obtains a compact pattern such that the quantity of unused space between the blanks 1 is reduced to a minimum. Naturally, the outer configuration of the stack is defined by the longitudinal edges 5 and transverse edges 6 of the blank 1, as well as by the total height of the stack, and the outer configuration also determines the configuration of the envelope or casing surrounding the stack of blanks, which completes the combination of the multipack. FIG. 5 shows the multipack with an envelope or casing 7 of, for example paper (corrugated cardboard). The casing 7 is in the form of a crate which is provided with a stabilising bottom 8 and whose upper end is open, apart from two longitudinal strips 9 which extend partly out over the upper, otherwise unprotected edges of the stacked packaging container blanks 1. Of course, it is also possible for the multipack to include an envelope or casing of other material, for example shrink film or the like, possibly in combination with corner protectors in the form of angle strips. By placing the blanks vertically in the casing with one of the longitudinal edges in abutment against the bottom 8, the loading on the individual blanks 1 will be distributed such that, on placing of a plurality of multipacks on top of one another, each individual blank will take up a loading which, in principle, but insignificantly exceeds the weight of a blank located above. This vertical placing also entails that the stacking of several multipacks on one another does not lead to increased pressure between the blanks included in the stack, for which reason the opening arrangements are not subjected to any increased loading. As a result, not only will damage to the opening arrangements be avoided, but also "pressure impressions" on the outsides of the blanks caused by the edges of the opening arrangements.

In addition to the above described embodiment in which each packaging container blank is individual, it is possible in a corresponding manner to realise a multipack in which the packaging containers 1 are combined side-by-side in the desired number, for example five packaging containers, which are mutually united along the longitudinal edges 5 to form a larger blank. "The edges" will, in this phase, merely be imaginary lines which correspond to the incision lines which will later divide the united blanks and form the actual edges of the individual blanks. In packaging machines of higher output capacity, this design may be preferable, in which event the division of the packaging container blanks into individual "part blanks" may be put into effect after removal of the packaging container blanks 1 from the casing 7 of the multipack.

As a result of the design of the multipack according to the present invention, a maximum number of prefabricated, flat-laid blanks may be transported in a minimum of space, at the same time as the multipack, thanks to the stacking pattern and protective casing, ensures that the risk of damage to the blanks and their projecting opening arrangements is reduced to a minimum.

The present invention should not be considered as restricted to that described above and shown on the Drawings, many modifications being conceivable without departing from the scope of the appended claim.

What is claimed is:

1. A multipack with blanks for packaging containers, comprising:

two pairs of blanks, each blank being flat-laid, rectangular and provided with an opening arrangement projecting from one side of the blank:

said opening arrangement being placed outside the lines of symmetry of said blank and at an upper end of said blank;

said blanks being placed pairwise adjacent one another with respective longitudinal and transverse edges in common planes;

said blanks included in each pair being placed with their opening arrangements towards one another and with the upper ends in the same direction; and one pair of said two pairs of blanks being turned through 180° so that said pairs have their upper ends turned alternatingly in opposite directions, said blanks being placed in substantially vertical position in the casing of the multipack and in abutment against the bottom of the multipack.

* * * * *